US007510384B2

(12) United States Patent
Chiou

(10) Patent No.: US 7,510,384 B2
(45) Date of Patent: Mar. 31, 2009

(54) CONCRETE WALL FABRICATION SYSTEM

(76) Inventor: Chi-lung Chiou, No. 8, Alley 26, Lane 53, Huiming St., Yuanlin Town, Changhua County (TW)

( * ) Notice: Subject to any disclaimer, the term of this patent is extended or adjusted under 35 U.S.C. 154(b) by 511 days.

(21) Appl. No.: 11/430,155

(22) Filed: May 9, 2006

(65) Prior Publication Data

US 2007/0261336 A1 Nov. 15, 2007

(51) Int. Cl.
*B28B 7/44* (2006.01)

(52) U.S. Cl. ..... 425/63; 425/335; 425/432; 425/456

(58) Field of Classification Search ..... 425/63–65, 425/253–255, 329, 335, 432, 456
See application file for complete search history.

(56) References Cited

U.S. PATENT DOCUMENTS 4,751,033 A * 6/1988 Kankkunen ..... 425/432
5,139,602 A * 8/1992 Suda et al. ..... 425/454
6,355,191 B1 * 3/2002 Toncelli ..... 425/432
6,764,294 B2 * 7/2004 Saddler ..... 425/253

* cited by examiner

*Primary Examiner*—Yogendra Gupta
*Assistant Examiner*—Thu Khanh T Nguyen
(74) *Attorney, Agent, or Firm*—Rosenberg, Klein & Lee

(57) ABSTRACT

A concrete wall fabrication system includes an endless track, mold carriers movably supported on the endless track for carrying a respective set of formworks for molding concrete into multiple concrete walls at a time, a concrete spouting unit set above the endless track and controlled to discharge a predetermined amount of concrete into each mold carrier, a vibrator unit set above the endless track and operable to vibrate the concrete in each mold carrier, and finished product collector unit set near one side of the endless track for collecting the finished concrete walls from each mold carrier for packing.

4 Claims, 9 Drawing Sheets

CONCRETE WALL FABRICATION SYSTEM

BACKGROUND OF THE INVENTION

1. Field of the Invention

The present invention relates to concrete construction and more particularly, to a concrete wall fabrication system.

2. Description of the Related Art

When making concrete walls for construction, formworks are arranged on the floor, and then concrete is spouted into the cavity in each mold formed of the formworks, and then a vibrator is manually operated to mix the concrete in each mold. Thereafter, the concrete in each mold is dried in the open air. This concrete wall fabrication method has drawbacks as follows:

1. Because formworks are set on the floor, it requires much floor space for molding the desired number of concrete walls.

2. It requires much labor to set up the formworks, to spout the concrete, to mix the concrete, to strip off the formworks after setting of the concrete, and to pick up the finished concrete walls.

Therefore, it is desirable to provide a concrete wall fabrication system, which eliminates the aforesaid problems.

SUMMARY OF THE INVENTION

The present invention has been accomplished under the circumstances in view. It is the main object of the present invention to provide a concrete wall fabrication method, which fabricate concrete walls efficiently in a mass production. According to one aspect of the present invention, the concrete wall fabrication system comprises an endless track, mold carriers movably supported on the endless track for carrying a respective set of formworks for molding concrete into multiple concrete walls at a time, a concrete spouting unit set above the endless track and controlled to discharge a predetermined amount of concrete into each mold carrier, and a vibrator unit set above the endless track and operable to vibrate the concrete in each mold carrier and to further expel bubbles out of the concrete in each mold carrier. According to another aspect of the present invention, a finished product collector unit is set near one side of the endless track for collecting the finished concrete walls from each mold carrier for packing automatically.

DETAILED DESCRIPTION OF THE PREFERRED EMBODIMENT

Figure 1:
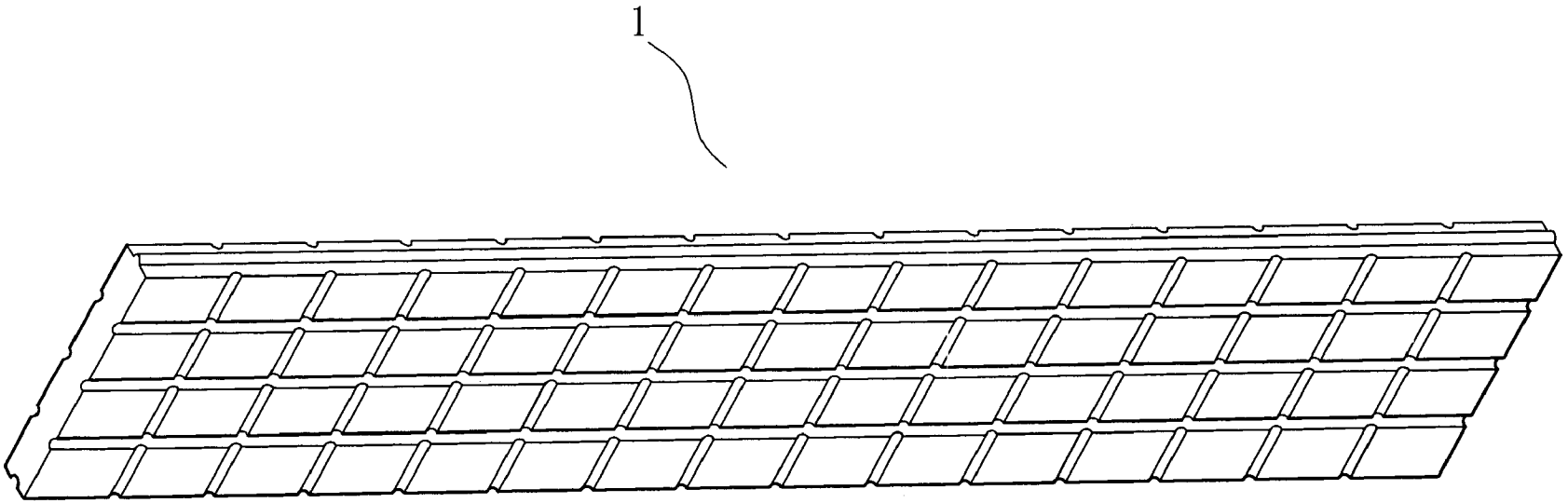
FIG. 1 is a perspective view of a finished concrete wall made according to the present invention.
Figure 2:
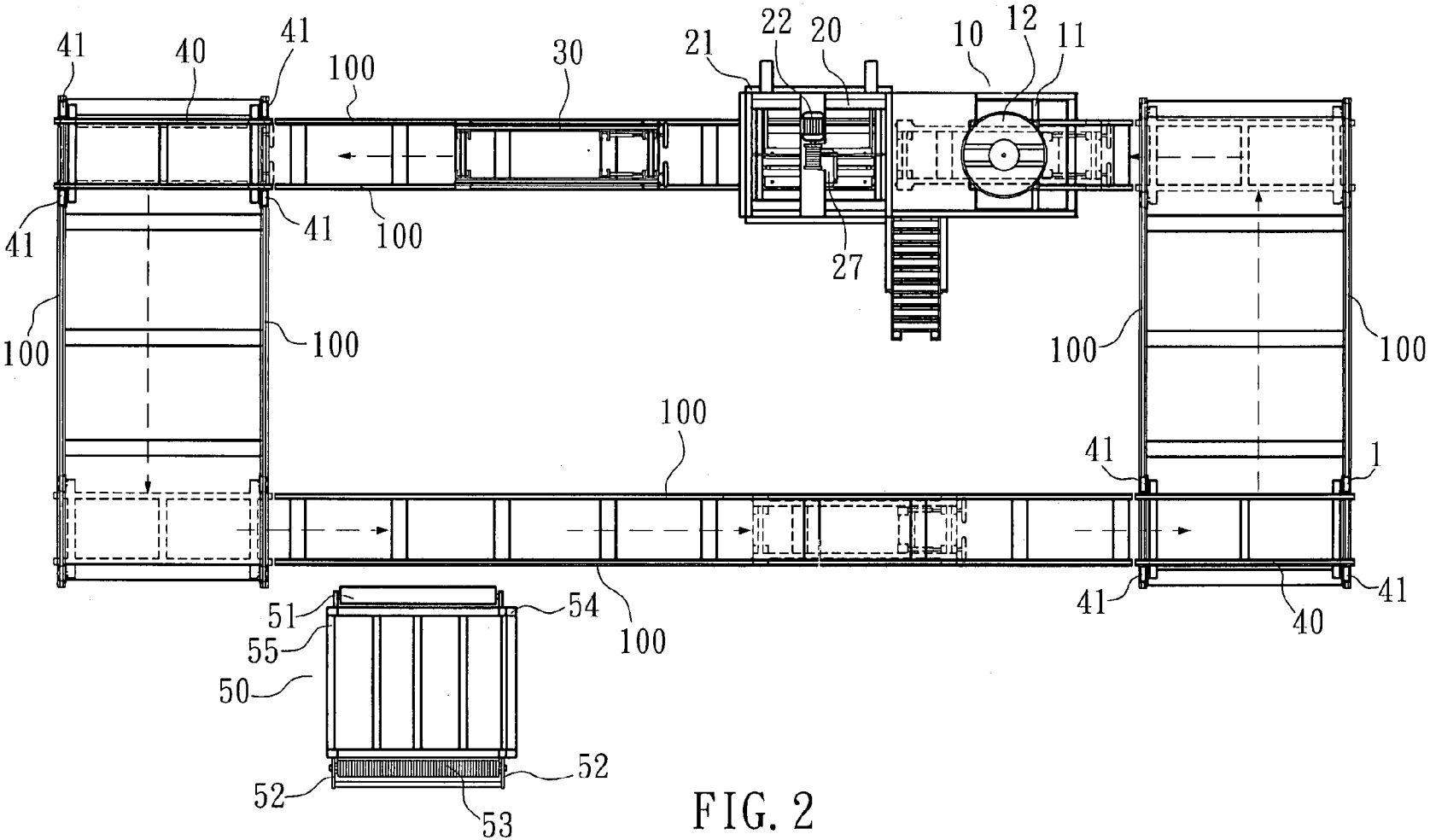
FIG. 2 is a schematic top view of a concrete wall fabrication system according to the present invention.
Figure 3:
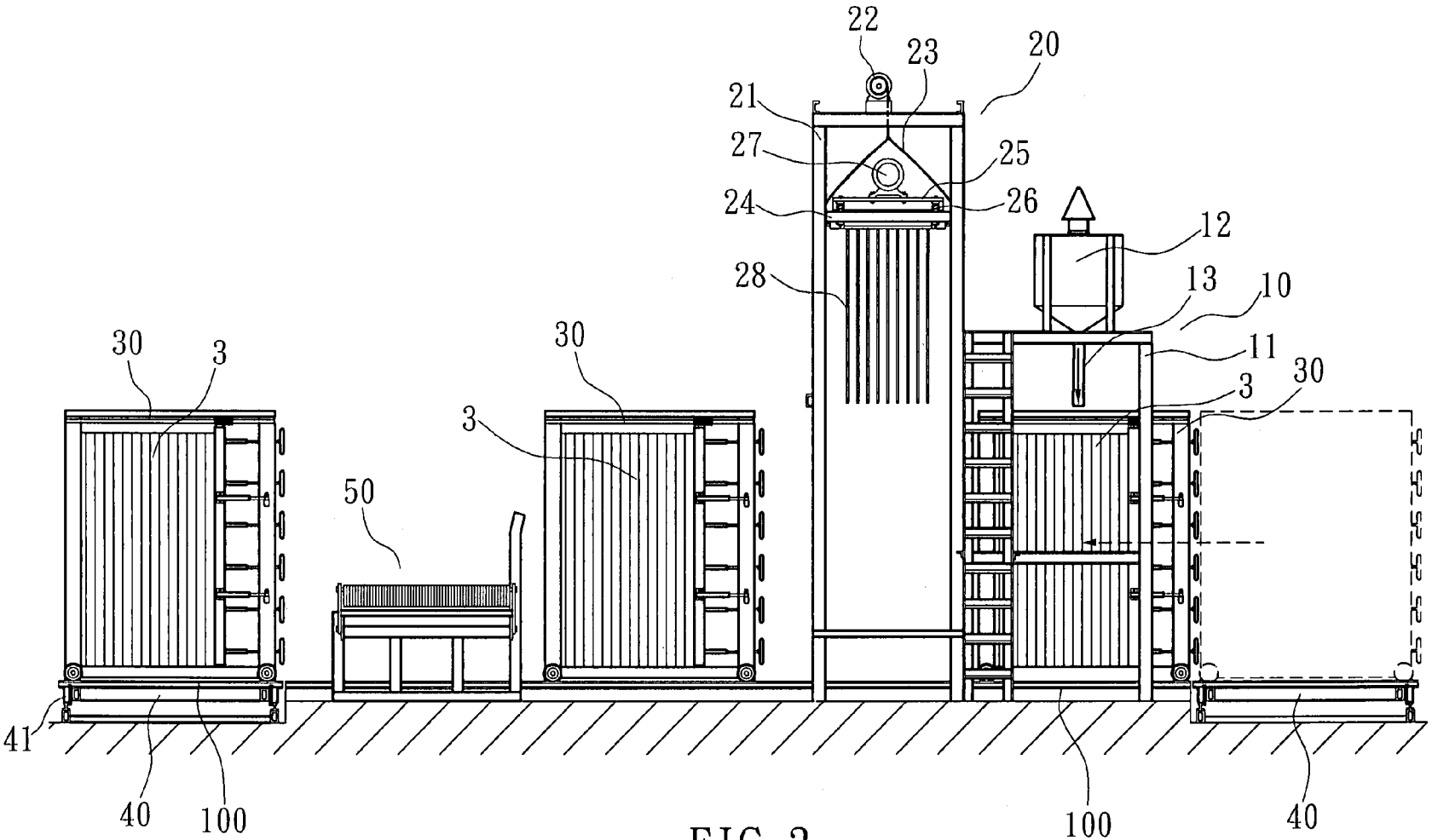
FIG. 3 is a front view of the concrete wall fabrication system according to the present invention.
Figure 4:
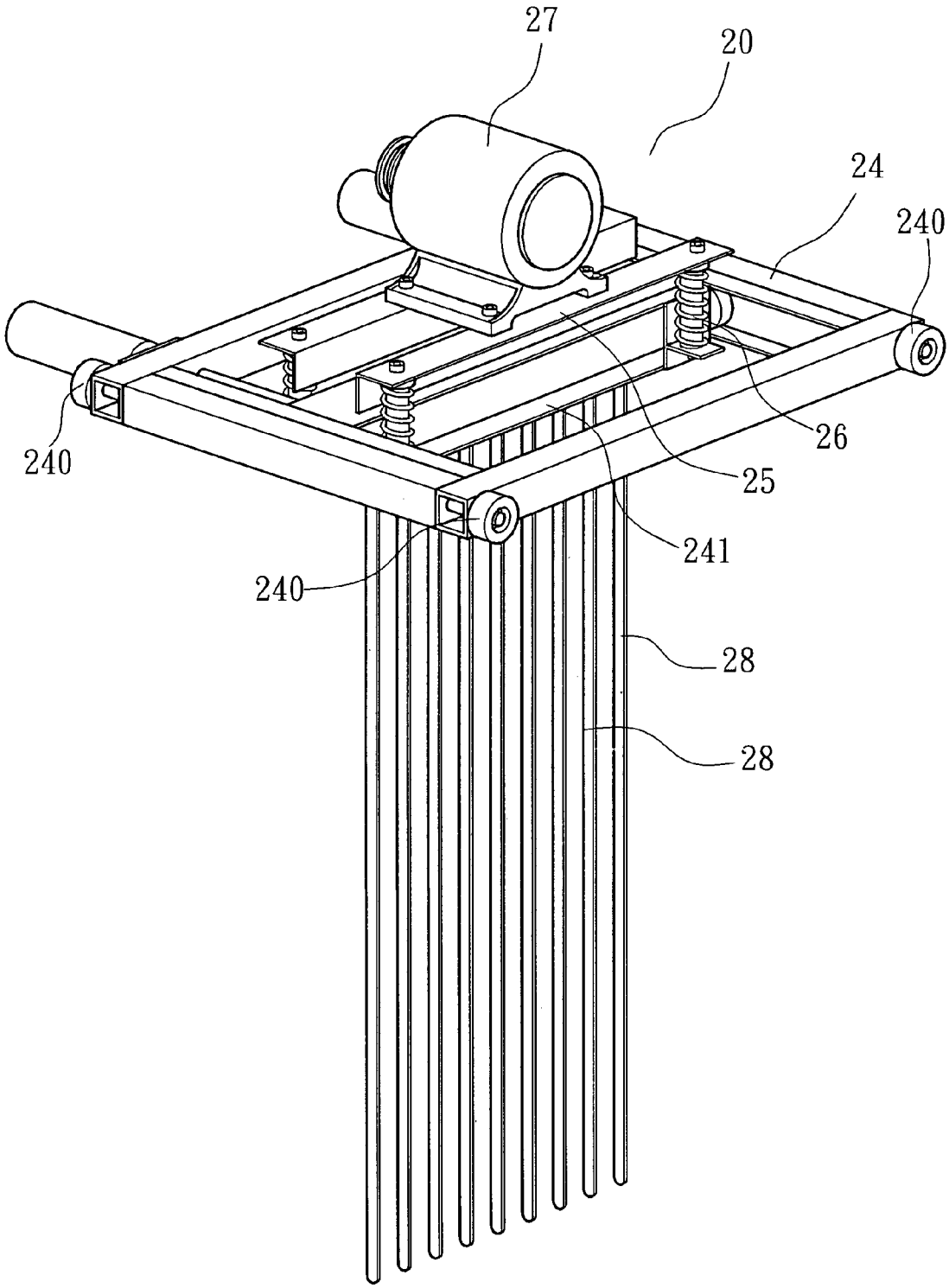
FIG. 4 is a perspective view in an enlarged scale of a part of the present invention, showing the structure of the vibrator unit.
Figure 5:
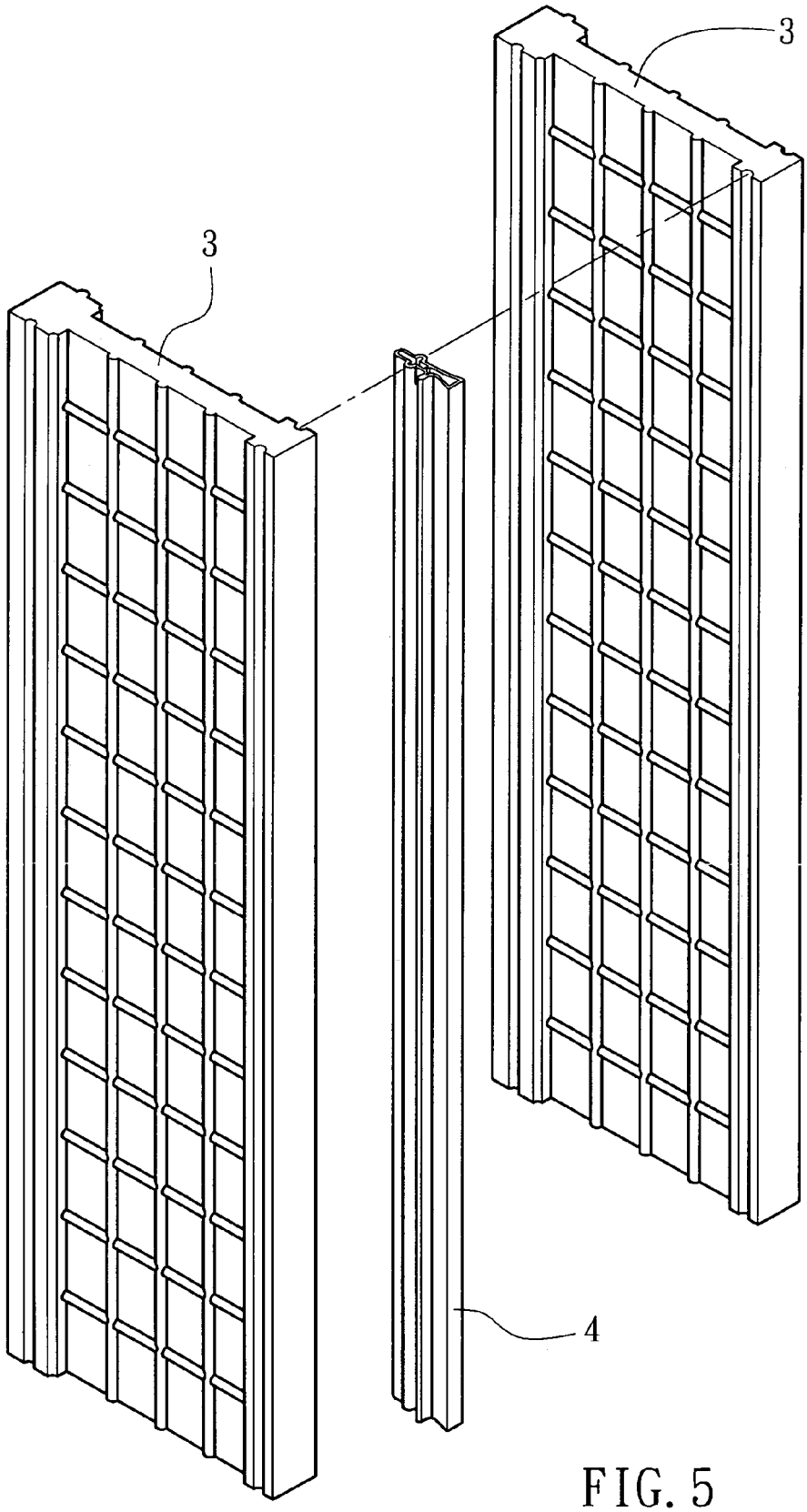
FIG. 5 is an exploded view showing a flexible plastic strip set in between two formworks according to the present invention.
Figure 6:
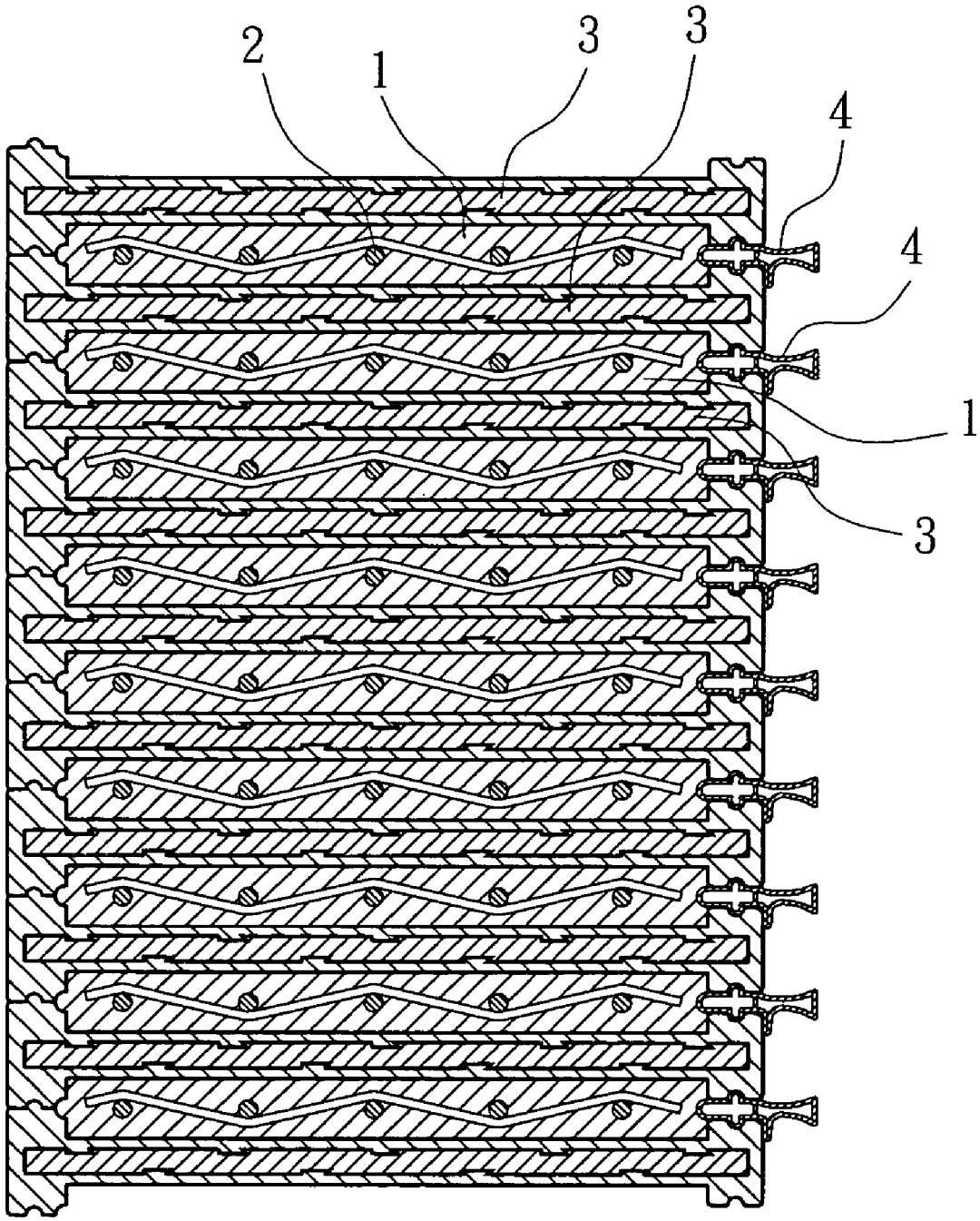
FIG. 6 is a top view in section of one mold carrier when filled up with the prepared concrete according to the present invention.
Figure 7:
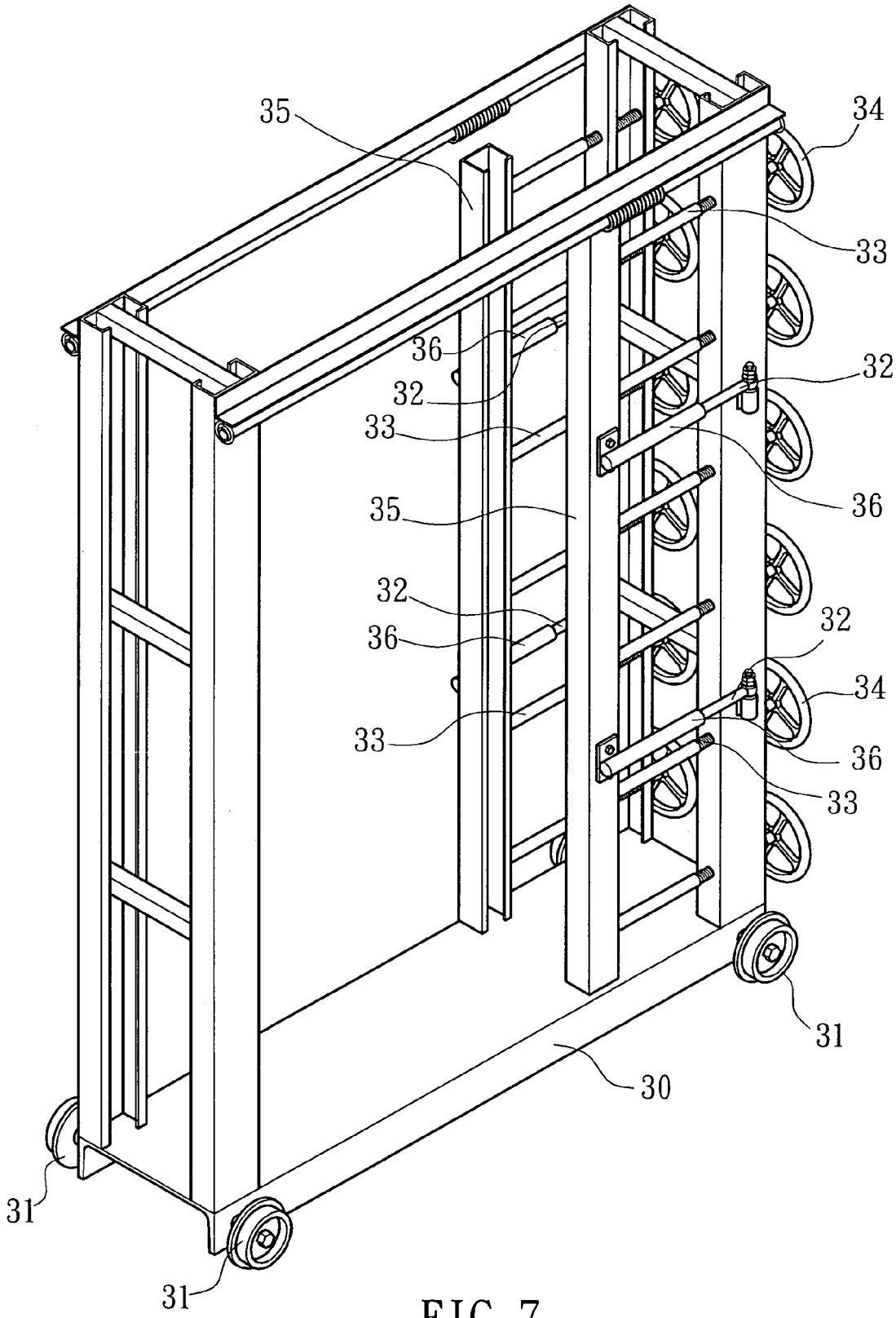
FIG. 7 is a perspective view in an enlarged scale of a part of the present invention, showing the structure of the mold carrier.
Figure 9:
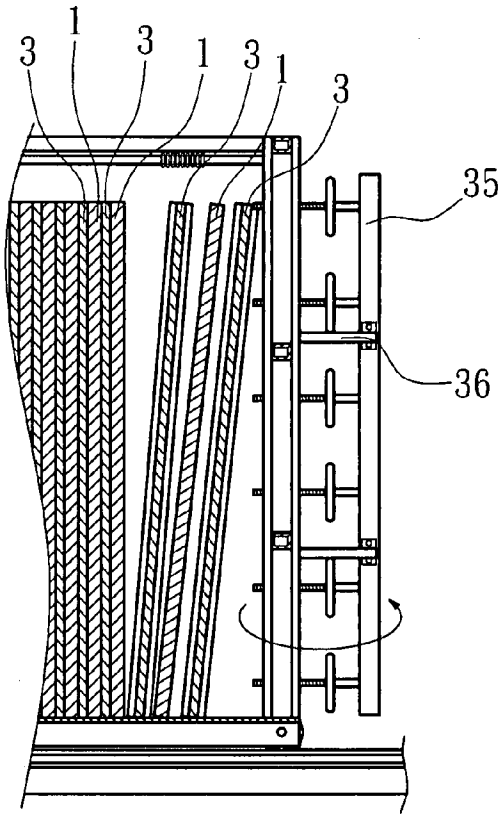
FIG. 9 is a schematic sectional view showing the mold stripping operation of the mold carrier according to the present invention.
Figure 8:
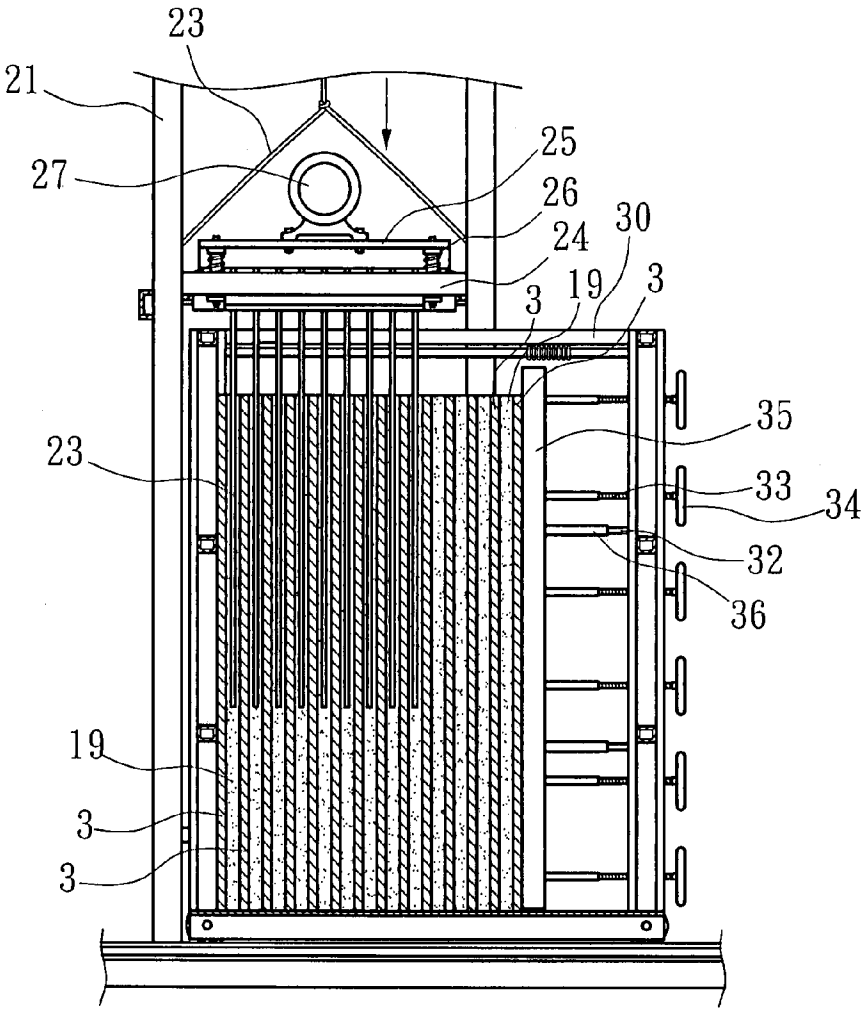
FIG. 8 is a schematic sectional view showing the vibration rods inserted into the concrete in one mold carrier according to the present invention.

Referring to FIGS. 2~11, a concrete wall fabrication system in accordance with the present invention is shown comprised of a concrete spouting unit 10, a vibrator unit 20, a plurality of mold carriers 30, multiple sets of formworks 3, a plurality of transfer carriages 40, a finished product collector unit 50, and an endless track 100.

The concrete spouting unit 10 and the vibrator unit 20 are mounted above the endless track 100. The mold carriers 30 and the transfer carriages 40 supported on and movable along the endless track 100. The concrete spouting unit 10 (see FIG. 3) comprises a high-rise rack 11, a concrete container 12 supported on the high-rise rack 11, and a concrete hose 13 downwardly extending from the concrete container 12 for guiding concrete out of the concrete container 12 into the formworks 3 in the mold carrier 30 that is moved on the endless track 100 to the inside of the high-rise rack 11.

The vibrator unit 20 (see FIGS. 3 and 4) comprises a high-rise rack 21, a hoisting motor 22 fixedly provided at the top side of the high-rise rack 21, a rectangular suspension frame 24, a plurality of pulleys 240 respectively pivotally mounted on the four corners of the rectangular suspension frame 24 and respectively supported on the inside wall (vertical bars) of the high-rise rack 21 to guide vertical movement of the rectangular suspension frame 24 along the inside wall (vertical bars) of the high-rise rack 21, a hoisting cable 23 coupled between the hoisting motor 22 and the rectangular suspension frame 24, a plurality of spring members 26 vertically mounted on the bottom wall 241 of the rectangular suspension frame 24, a vibration mount 25 supported on the spring members 26, a vibration motor 27 mounted on the vibration mount 25, and a plurality of vibration rods 28 vertically downwardly extending from the vibration mount 25. When one set of formworks 3 is carried by the associating mold carrier 30 to the inside of the high-rise rack 21, the hoisting motor 22 is operated to lower the rectangular suspension frame 24 and to force the vibration rods 28 into the concrete in between the formworks 3, and then the vibration motor 27 is started to vibrate the vibration mount 25 and the vibration rods 28, thereby eliminating bubbles from the concrete in between the formworks 3.

The formworks 3 (see FIGS. 5 and 6) are flat form panels arranged in parallel in the associating mold carrier 30 for molding concrete into a number of concrete walls 1 (see FIG. 1) at a time. Further, a flexible plastic strip 4 is respectively inserted in between each two adjacent formworks 3 at one side to seal the gap during molding and to facilitate the action of stripping off the formworks after molding.

The mold carrier 30 (see FIGS. 7~9) comprises four wheels 31 pivotally provided in the four corners of the bottom side thereof and respectively supported on the endless track 100 for allowing movement of the mold carrier 30 along the endless track 100, pairs of supporting rods 32 respectively pivotally arranged in parallel at different elevations, two vertical pressure bars 35, a plurality of sleeves 36 respectively fixedly mounted on the vertical pressure bars 35 at different elevations and respectively sleeved onto the supporting rods 32, a plurality of screw rods 33 respectively stopped against the vertical pressure bars 35 at different elevations, and hand wheels 34 respectively mounted on the screw rods 33 for rotation by the user to move the respective screw rods 33 and to further force the vertical pressure bars 35 against the formworks 3 set in the mold carrier 30 from two sides.

The transfer carriages 40 are flat vehicles each having four wheels 41 disposed in the four corners and respectively supported on the relatively lower track sections of the endless track 100 at turning corner areas for carrying the mold carriers 30 between two relatively higher track sections.

The finished product collector unit 50 (see FIGS. 10 and 11) comprises a base 55, an upright stop frame 54 disposed at a back side, a roller 51 provided at one lateral side, two swinging arms 52 provided at the other lateral side, and stop plates 53 connected in parallel between the swinging arms 52. The roller 51 is adapted to guide finished concrete walls 1 into the base 55. The stop plates 53 are movable with the swinging arms 52 to support the loaded concrete walls 1 at the upright stop frame 54.

According to the present preferred embodiment, the endless track 100 is arranged in a rectangular configuration having two long track sections arranged at a relatively higher position and two short track sections connected between the long track sections and arranged at a relatively lower position. The high-rise racks 11 and 21 of the concrete spouting unit 10 and the vibrator unit 20 are set above the endless track 100 so that the mold carriers 30 can be moved in and out of the high-rise racks 11 and 21. According to the present preferred embodiment, the number of the carriages 40 is 2. These two carriages 40 are respectively supported on the two short track sections of the endless track 100 and kept in flush with the two long track sections of the endless track 100. The finished product collector unit 50 is set near one side of the endless track 100 for collecting finished concrete walls 1 from the formworks 3 in each mold carrier 30.

The operation of the concrete wall fabrication system is outlined hereinafter. The prepared formworks 3 are set in the mold carriers 30 (see FIG. 8), and then the mold carriers 30 are moved into the concrete spouting unit 10 in proper order, allowing concrete 19 to be discharged out of the concrete container 12 through the concrete hose 13 into the cavity between each two formworks 3. Further, a reinforcing iron net 2 may be set in the cavity between each two formworks 3 (see FIG. 6). Thereafter, the mold carriers 30 are moved in proper order into the vibrator unit 20. When one mold carrier 30 entered the vibrator unit 20, the hoisting motor 22 is started to lower the suspension frame 24 and to insert the vibration rods 28 into the concrete 19 in between each two adjacent formworks 3 in the mold carrier 30, and then the vibration motor 27 is started to vibrate the vibration rods 28 so as to further expel bubbles out of the concrete 19 after the hoisting motor 22 has been turned off. Thereafter, the hoisting motor 22 is started and rotated in the reversed direction to lift the vibration rods 28 from the mold carrier 30. Thereafter, the mold carrier 30 is moved out of the vibrator unit 20 to one transfer carriage 40 and kept there for drying the concrete 19 in air. After hardening of the concrete 19, each mold carrier 30 is moved away from the corresponding transfer carriage 40 to the other long track section of the endless track 100 adjacent to the finished product collector unit 50 (see FIG. 9), and then the finished concrete walls 1 are transferred from each mold carrier 30 to the finished product collector unit 50 for packing and further delivery. After stripping, the formworks 3 are inserted into each mold carrier 30, and each mold carrier 30 is moved along the endless track 100 to the concrete spouting unit 10 again for receiving the concrete 19.

Referring to FIGS. 7 and 8 again, when multiple formworks 3 are inserted into one mold carrier 30, the hand wheels 34 are rotated to move the screw rods 33 and the vertical pressure bars 35, causing the pressure bars 35 to hold down the inserted formworks 3. When stripping off the mold, rotating the hand wheels 34 in the reversed direction to release the pressure bars 35 from the formworks 3 (see FIG. 9), so that the formworks 3 and the finished concrete walls 1 can be conveniently taken away from the mold carrier 30.

Figure 10:
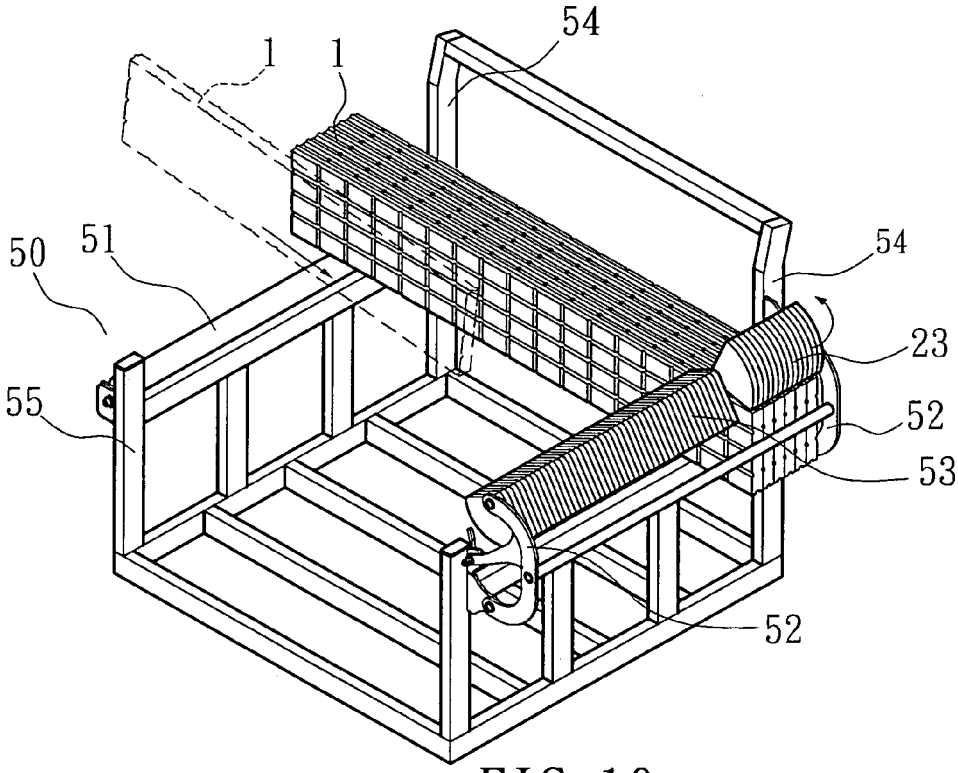
FIG. 10 is a schematic drawing showing finished concrete walls guided into the finished product collector unit according to the present invention.
Figure 11:
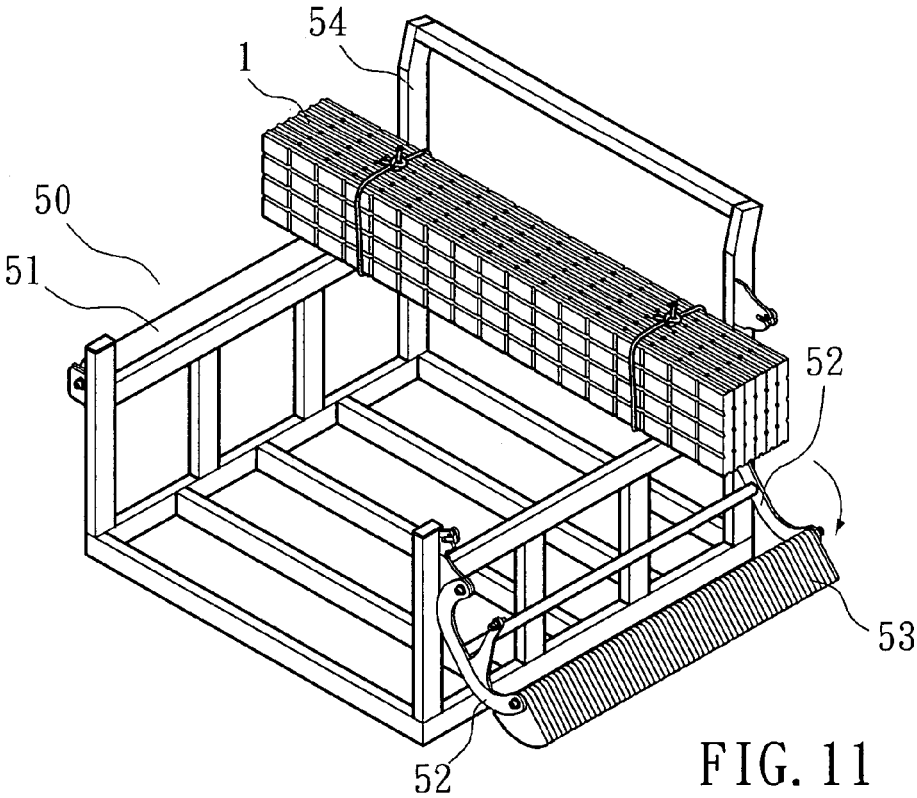
FIG. 11 corresponding to FIG. 10, showing finished concrete walls packed in the finished product collector unit according to the present invention.

Referring to FIG. 10, when stripped off the mold (formworks) in each mold carrier 30, the finished concrete walls 1 are guided obliquely forwards by the roller 51 into the base 55 of the finished product collector unit 50 and stopped at the upright stop frame 54 and the stop plates 53 for packing. After packing, the swinging arms 52 are turned outwardly downwards to remove the stop plates 53 from the packed concrete walls 1, allowing the packed concrete walls 1 to be carried away by a hoisting engine or the like.

As indicated above, the concrete wall fabrication system of the present invention has the following advantages:

1. The system uses an endless track 100 and the movable mold carriers 30 and transfer carriages 40, thereby saving much labor and accelerating the fabrication speed.

2. Multiple formworks 3 are set in each mold carrier 30 for quick production of multiple concrete walls 1 at a time.

3. The concrete spouting unit 10 and the vibrator unit 20 have the respective high-rise racks 11 and 21 set above the endless track 100 for quick performance of concrete spouting and vibration procedures.

4. The vibrator unit 20 uses a vibration motor 27 to vibrate multiple vibration rods 28 so that bubbles can be quickly eliminated from the concrete carried in each mold carrier 30.

5. After concrete spouting, the formworks are kept in vertical for drying the concrete, saving much floor space.

6. The concrete spouting unit 10 is set to discharge a predetermined amount of the prepared concrete, and the vibrator unit 20 is operated to vibrate the concrete in each mold carrier 30 and to further expel bubbles from the concrete, and therefore the finished concrete walls 1 have a constant quality.

7. By means of the finished product collector unit 50, finished concrete walls 1 are gathered and packed efficiently with less labor.

Although a particular embodiment of the invention has been described in detail for purposes of illustration, various modifications and enhancements may be made without departing from the spirit and scope of the invention.

What the invention claimed is:

1. A concrete wall fabrication system comprising:

an endless track;

a plurality of formworks for molding concrete into a number of concrete walls;

a plurality of mold carriers movable on said endless track and adapted to carry said formworks to said concrete spouting unit and said vibrator unit, said mold carriers each comprising a plurality of wheels movably supported on said endless rack, pairs of supporting rods respectively pivotally arranged in parallel at different elevations, two vertical pressure bars, a plurality of sleeves respectively fixedly mounted on said vertical pressure bars at different elevations and respectively sleeved onto said supporting rods, a plurality of screw rods respectively stopped against said vertical pressure bars at different elevations, and hand wheels respectively mounted on said screw rods for rotation by the user to move said screw rods and to further force said vertical pressure bars against the formworks set in the respective mold carrier;

a concrete spouting unit, said concrete spouting unit comprising a high-rise rack set above said endless track, a concrete container supported on the high-rise rack of said concrete spouting unit, and a concrete hose downwardly extending from said concrete container for guiding concrete out of said concrete container into the formworks in each mold carrier being moved on said endless track to the inside of the high-rise rack of said concrete spouting unit; and a vibrator unit, said vibrator unit comprising a high-rise rack set above said endless track, a hoisting motor fixedly provided at a top side of the high-rise rack of said vibrator unit, a rectangular suspension frame, a plurality of pulleys respectively pivotally mounted on four corners of said rectangular suspension frame and respectively supported on an inside wall of the high-rise rack of said vibrator unit to guide vertical movement of said rectangular suspension frame along the high-rise rack of said vibrator unit, a hoisting cable coupled between said hoisting motor and said rectangular suspension frame, a plurality of spring members vertically mounted on a bottom wall of said rectangular suspension frame, a vibration mount supported on said spring members, a vibration motor mounted on said vibration mount and adapted to vibrate said vibration mount, and a plurality of vibration rods vertically downwardly extending from said vibration mount for inserting into the concrete carried in between the formworks in each of said mold carrier to vibrate the concrete and to expel bubbles from the concrete.

2. The concrete wall fabrication system as claimed in claim 1, further comprising a plurality of flexible plastic strips respectively inserted in between each two adjacent formworks in each of said mold carriers at one side to seal the gap between each two adjacent formworks.

3. The concrete wall fabrication system as claimed in claim 1, further comprising a plurality of transfer carriers set in each turning angle at one low track section of said endless track between two high track sections of said endless tracks and kept in flush with said high track sections, said transfer carriers each having a plurality of wheels supported on said low track section of said endless track and being adapted to carry said mold carriers between the two high track sections of said endless track.

4. The concrete wall fabrication system as claimed in claim 1, further comprising a finished product collector unit set near one side of said endless track and adapted to collect finished concrete walls from each of said mold carriers, said finished product collector unit comprising a base, an upright stop frame disposed at a back side thereof, a roller provided at a first lateral side thereof near said endless track and adapted to guide finished concrete walls from each of said mold carriers to the base of said finished product collector unit, two swinging arms provided at a second lateral side thereof, and stop plates connected in parallel between said swinging arms for stopping collected finished concrete walls at said upright stop frame.

* * * * *